United States Patent [19]

Kelly et al.

[11] 4,419,327

[45] Dec. 6, 1983

[54] METHOD OF SCAVENGING DISSOLVED OXYGEN IN STEAM GENERATING EQUIPMENT USING AMMONIA OR AMINE NEUTRALIZED ERYTHORBIC ACID

[75] Inventors: John A. Kelly, Woodridge; Cynthia A. Soderquist, Bolingbrook, both of Ill.

[73] Assignee: Nalco Chemical Company, Oak Brook, Ill.

[21] Appl. No.: 333,379

[22] Filed: Dec. 22, 1981

[51] Int. Cl.[3] ..... C23F 11/10

[52] U.S. Cl. ..... 422/17; 210/750

[58] Field of Search ..... 210/757, 750; 422/16, 422/17; 252/178

[56] References Cited

U.S. PATENT DOCUMENTS

| | | | |
|---|---|---|---|
| 3,329,607 | 7/1967 | Colobert et al. | 422/17 |
| 3,637,772 | 1/1972 | Klaui et al. | 260/398.5 |
| 3,681,492 | 8/1972 | Kotzbauer | 424/141 |
| 3,749,680 | 7/1973 | Hinkley | 252/400 A |

FOREIGN PATENT DOCUMENTS

| | | | |
|---|---|---|---|
| 45-13521 | 5/1970 | Japan | 422/17 |
| 45-14202 | 6/1970 | Japan | 422/17 |

OTHER PUBLICATIONS

Acta. Chim. Acad. Sci. Hung., vol. 14, 1958, pp. 95–10-5–1958.

Pfizer Data Sheet No. 637, Apr. 1971.

*Primary Examiner*—Thomas G. Wyse

*Attorney, Agent, or Firm*—Hosier, Niro & Daleiden

[57] ABSTRACT

A method of scavenging oxygen and passivating metal surfaces in steam generating equipment by treating feedwater with an ammonia or amine neutralized erythorbate form thereof.

8 Claims, No Drawings

METHOD OF SCAVENGING DISSOLVED OXYGEN IN STEAM GENERATING EQUIPMENT USING AMMONIA OR AMINE NEUTRALIZED ERYTHORBIC ACID

BACKGROUND OF THE INVENTION

The present invention relates generally to the control of corrosion in steam generating equipment, and more particularly, to an improved boiler feedwater conditioning method for removing dissolved oxygen and passivating metal surfaces.

The treatment of water for use in steam generating equipment is a very critical and complex art due to the numerous sources of scaling, corrosion and other water related problems typically encountered in operating such equipment. This invention is concerned with a method of conditioning feedwater to protect preboiler, boiler and condensate systems of steam generating equipment against corrosion during operation and lay-up.

The most common source of corrosion in such systems is oxygen attack of steel components. Unfortunately, oxygen attack of steel is accelerated by the unavoidably high temperatures found in boiler equipment. Also, if boiler water pH is permitted to become acidic (which helps control scale formation), oxygen attack is yet further accelerated.

In most modern steam generating systems, dissolved oxygen levels are controlled by first mechanically removing the bulk of the dissolved oxygen and then chemically scavenging the remainder. Mechanical degasification is typically carried out with vacuum degasifiers which reduce oxygen levels to less than 0.5–1.0 mg/l or deaerating heaters, which reduce oxygen concentrations to 0.005–0.01 mg/l.

Traditionally, sodium sulfite and hydrazine have been used to chemically scavenge the oxygen remaining in steam generating systems after the initial mechanical removal of the bulk of the dissolved oxygen. Each of these traditional treatments has significant shortcomings.

Sodium sulfite, for example, is not recommended for use in systems operating above 1500 psi because corrosive hydrogen sulfide and sulfur dioxide can be formed at pressures above this point. Also, sodium sulfite can contribute to increased dissolved solids in the feedwater, requiring higher boiler blowdown rates and, therefore, higher water, fuel and chemical costs.

Hydrazine is less effective than sulfite in removing oxygen. However, since hydrazine also acts as a corrosion inhibitor by maintaining a passive, protective film on system components, it is an effective alternative to sulfite. Unfortunately, though, hydrazine is a toxic substance which must be handled with extreme care in all applications. Indeed, Food and Drug Administration rules prohibit the presence of measurable quantities of hydrazine in any applications in which it might come in contact with food.

It is, therefore, an object of the present invention to provide an improved method for scavenging oxygen in steam generating systems which relies on neither sulfite nor hydrazine.

It is a further object of the present invention to provide a feedwater conditioning method for passivating metal surfaces in steam generating equipment without relying on hydrazine.

Other objects and advantages of the present invention will become apparent from the discussion below.

SUMMARY OF THE INVENTION

The improved method of the present invention generally entails treating boiler feedwater with a scavenging agent comprising ammonium and amine neutralized erythorbic acid to remove dissolved oxygen and to passivate metal surfaces. Useful amine salts include the erythorbates of morpholine, cyclohexylamine, diethanolamine and triethanolamine. The ammonium neutralized erythorbate is the most preferred agent. Ammonium neutralized erythorbate is the most preferred agent because it does not contribute to system solids levels and because it can be formulated in concentrates at up to a 25 percent by weight actives level. Furthermore, the ammonium form has been found to react faster with oxygen at higher temperatures than the corresponding sodium salt (Example 3 below).

The key parameters governing the effectiveness of an oxygen scavenging agent are its reactivity with oxygen, with metal surfaces, and with feedwater contaminates. These parameters are dependent upon both temperature and chemical concentrations. The scavenging agents of the present invention are effective oxygen scavengers over the entire range of temperatures found in conventional steam generating equipment, which generally lie between 190–350 degrees F. Furthermore, these compounds are believed to be effective even at temperatures below 190 degrees F. and well in excess of 350 degrees F.

The amount of neutralized erythorbate required to effectively scavenge oxygen from the water of a steam generating system is dependent upon the amount of oxygen actually present therein, as well as upon the pH of the system and other system characteristics. Therefore, the optimal concentration of the present scavenging agents will have to be determined on a case by case basis. In general, however, it is believed that feedwater concentrations of at least 0.025 ppm by weight will be required and that more preferred concentration levels will be at least about 0.1 ppm by weight.

A desirable ammonium neutralized erythorbate concentrate can be made by preparing a 25 percent by weight erythorbic acid solution and adding sufficient ammonium hydroxide to adjust the pH of the solution to at least about 5.0 and preferably about 6.0±0.5. Adjustment to pH 6.0±0.5 will require approximately 10.5 percent by weight aqueous ammonia.

This 25 percent ammonium neutralized erythorbate concentrate has been found to have excellent activity retention both at room temperature and at 120 degrees F. which corresponds to typical drum summer storage conditions. The 120 degrees F. finding is significant, since it runs contrary to the teaching of the literature that solutions of erythorbic acid are more stable under acid pH conditions.

Although the present scavenging agents may be added to the steam generating equipment at any convenient point, it is more efficient to treat the boiler feedwater, preferably as it comes from the degasifier. Residence times prior to steam formation should be maximized to obtain maximum corrosion protection. While the treatment chemical will control corrosion even when residence times are as low as 2–3 minutes, residence times of 15–20 minutes or more are preferred, if they can be achieved in the particular steam generating equipment being treated.

The scavenging agents employed in the practice of the present invention have been found to be not only good oxygen scavengers, but also excellent passivating agents for steel, steel alloys and other metallic surfaces. These compounds outperform both hydrazine and sulfite in passivation. They preferentially interact with metal surfaces enhancing passive films formation in mild steel and copper alloy surfaces.

As in the case of oxygen scavenging to control corrosion, the optimal treatment levels for passivation must be determined on a case by case basis. However, in most systems, satisfactory passivation can be achieved during the initial 12–24 hours of operation of the system with the present treatment by maintaining the dosage chosen for oxygen scavenging.

Finally, while the present scavenging agents may be used alone in the practice of the present invention, their activity may be enhanced by the addition of pro-oxidant catalysts such as copper, nickel and iron. The catalyst level in the feedwater typically should be at least about 5 ppb by weight.

The following examples are intended to illustrate the practice of the present invention.

EXAMPLES

EXAMPLE 1

In this example, a 25 percent solution of erythorbic acid adjusted to pH 6±0.5 with ammonium hydroxide was compared to the hydrazine as an oxygen scavenger in an electric utility boiler operating at more than 1500 psig.

The utility steam generating system handled a variable load ranging from 800,000 lb./hr. to about 300,000 lb./hr., depending on electricity demands. The boiler had no deaerator. Its preboiler system consisted of a series of six stage heaters and an economizer.

The treatment program already in place at the time of the present testing entailed:

(1) An oxygen scavenger in the form of a 35 percent solution of hydrazine fed just prior to the feedwater pump; and, (2) Coordinated phosphate with mono- and/or trisodium phosphate fed to the boiler mud drum and 50 percent caustic added as needed.

The control limits for the system were as follows:

(1) Less than 5 ppb $O_2$ at economizer inlet;

(2) 10–30 ppm $PO_4$;

(3) Less than 0.4 ppm $SiO_2$;

(4) 4–12 ppm P alkalinity;

(5) 20–45 ppb $N_2H_4$ at boiler feed pump;

(6) 10–25 ppb $N_2H_4$ at economizer inlet.

The ammonium hydroxide neutralized erythorbic acid was initially fed at the same locations as the hydrazine. The first and lowest dosage was 0.15 ppm of product and resulted in a significant decrease in oxygen level.

The existing treatment program at this steam generating plant utilized a 0.2–0.4 ppm hydrazine feed. Oxygen concentrations in the system ranged from 9 to 25 ppb, regardless of the level of hydrazine residual in the system, which ran up to 90+ ppb. The ammonia neutralized erythorbic acid treatment significantly outperformed hydrazine in oxygen removal when fed at equivalent concentrations. In fact, where hydrazine was unable to meet the specified 5 ppb oxygen control limit, the ammonium neutralized erythorbate did. Furthermore, iron levels at the condensate hotwell and feedwater pump sample points were significantly lower than experienced with hydrazine, thus indicating that the ammonia neutralized erythorbic acid treatment produced enhanced corrosion inhibition in this system. Finally, conductivity and pH in the boiler water remained consistent, indicating that the ammonia neutralized erythorbic acid treatment had little effect on the phosphate program already in place.

EXAMPLE 2

In this example, metal surface passivation was examined in an experimental boiler utilizing a shell and tube heat exchanger to simulate a stage heater. Feedwater in this experimental system was made up with an oxygen content of 80 ppb. The inlet temperature to the heat exchanger was 100 degrees F. and the outlet temperature was 360 degrees F.

Feedwater treated with hydrazine was compared with feedwater treated with a 25 percent by weight erythorbic acid solution neutralized to pH 6.0±0.5 with ammonium hydroxide to produce samples for passivation testing. Metallographic examination of the tube surfaces showed a uniform adherent magnetite film with the erythorbic acid treatment that was clearly superior to that formed with hydrazine. The erythorbic acid treated tubes were free of pitting and better than those treated with hydrazine, which, in turn, were better than those contacting untreated feedwater.

EXAMPLE 3

In this example, the reaction rates of sodium erythorbate and ammonium neutralized erythorbate were examined. It was found that, at room temperature, sodium erythorbate and ammonium neutralized erythorbate react with oxygen at approximately equal rates. At high temperatures (e.g. temperatures in excess of 160 degrees F.), however, the ammonium form reacts with oxygen at a rate approximately 30 percent faster than the sodium form.

While the present invention is described above in connection with preferred or illustrative embodiments, the embodiments are not intended to be exhaustive or limiting of the invention. Rather, the invention is intended to cover any alternatives, modifications, or equivalents that may be included within its spirit and scope, as defined by the appended claims.

We claim:

1. A method of removing dissolved oxygen from boiler feedwater and passivating boiler metal surfaces comprising adding to said boiler feedwater an oxygen scavenging amount of an ammonium or amine neutralized erythorbate at a pH of at least about 5.0.

2. The method of claim 1 wherein ammonium neutralized erythorbate is used.

3. The method of claim 2 wherein said ammonium neutralized erythorbic acid is added to said feedwater at a level of at least 0.025 ppm by weight.

4. The method of claim 2 wherein said ammonium neutralized erythorbate solution is pH adjusted to about 6.0±0.5.

5. The method of claim 2 wherein a pro-oxidant catalyst is utilized.

6. The method of claim 2 wherein said catalyst is utilized at a level of at least about 5 ppb by weight.

7. The method of claim 2 wherein said catalyst is chosen from the group comprising copper, nickel and iron.

8. The method of claim 2 wherein said pH is at least about pH 6.0±0.5 and said ammonium neutralized erythorbate is added to said feedwater at a level of at least about 0.01 ppm by weight.

* * * * *